US005839616A

United States Patent [19]

Irwin et al.

[11] Patent Number: 5,839,616

[45] Date of Patent: Nov. 24, 1998

[54] BLOW MOLDED CONTAINER HAVING PIVOTAL CONNECTOR FOR AN ACTUATION LEVER

[75] Inventors: Aram Jesse Irwin, Portland, Oreg.; Gerard Laurent Buisson, Cincinnati, Ohio; Reuben Earl Oder, Union, Ky.

[73] Assignee: The Procter & Gamble Company, Cincinnati, Ohio

[21] Appl. No.: 911,591

[22] Filed: Aug. 14, 1997

[51] Int. Cl.[6] ..... B05B 9/043

[52] U.S. Cl. ..... 222/321.8

[58] Field of Search ..... 222/321.8, 381, 222/383.1

[56] References Cited

U.S. PATENT DOCUMENTS

| | | | |
|---|---|---|---|
| Re. 12,502 | 7/1906 | Bourne . | |
| D. 18,966 | 3/1889 | Davis . | |
| Re. 20,456 | 7/1937 | McClarin, Sr. . | |
| D. 208,826 | 10/1967 | Hutton . | |
| D. 238,655 | 2/1976 | McKinney et al. . | |
| D. 238,753 | 2/1976 | McKinney et al. . | |
| D. 255,776 | 7/1980 | Britt . | |
| D. 282,526 | 2/1986 | Wilson et al. . | |
| D. 310,169 | 8/1990 | Kowollik et al. . | |
| D. 373,956 | 9/1996 | Terwilleger et al. . | |
| D. 376,318 | 12/1996 | Hildebrand . | |
| D. 376,839 | 12/1996 | Hung . | |
| 412,479 | 10/1889 | Davis . | |
| 694,969 | 3/1902 | Kemp . | |
| 822,646 | 6/1906 | Bourne . | |
| 966,165 | 8/1910 | Cobb . | |
| T990,002 | 1/1980 | Stoesser | 222/321.8 X |
| T990,003 | 1/1980 | Sweeney | 222/321.8 |
| T993,004 | 4/1980 | French | 222/321.8 |
| 2,877,934 | 3/1959 | Wallace . | |
| 2,941,700 | 6/1960 | Gable . | |
| 3,055,041 | 9/1962 | Schaich . | |
| 3,109,565 | 11/1963 | Kutik . | |
| 3,146,916 | 9/1964 | Kronheim . | |
| 3,318,493 | 5/1967 | Belpedio . | |
| 3,478,935 | 11/1969 | Brooks . | |
| 3,758,978 | 9/1973 | Theodore . | |
| 3,770,206 | 11/1973 | Tada | 222/383.1 X |
| 3,797,749 | 3/1974 | Tada | 222/321.8 X |
| 3,913,841 | 10/1975 | Tada | 222/321.8 X |

(List continued on next page.)

FOREIGN PATENT DOCUMENTS

WO 93/06749 4/1993 WIPO .

OTHER PUBLICATIONS

"Nippon Lever—JIF Kitchen Spray Package (photographs of Japanese package)".

Updown Container Corporation Inc., 557 Melita Crescent, Toronto, Canada M6G 3Y7 (black & white photocopy showing Ketchup and Hand & Body Lotion).

Nalgene® Packaging Products Catalog (©1995 Nalge Nunc International) p. 25 "Dropper Bottle Closure Assembly, PP Dispensing Tip, PP Containment Cap with LDPE Insert".

"Sprayable spread butters up consumers" Packaging Digest® vol. 32 No. 1 (Jan. 1995—Circle No. 444).

"Haarspray ohne Treibgas mit Leicht–Sprüh–system und Austausch–Flasche" Aerosol Spray Report, vol. 30, No. 7/91.

*Primary Examiner*—Kevn P. Shaver
*Attorney, Agent, or Firm*—Rodney M. Young

[57] ABSTRACT

The present invention relates to a package for dispensing a liquid product having a blow molded container body including an aperture and a pivotal connection. A pump device is attached to the aperture, and a unitarily formed actuation lever is pivotally connected directly to the pivotal connection of the container body allowing arcuate movement of the actuation lever. The pump device has a first contact surface located on a portion thereof and the actuation lever has a second contact surface which cooperates with the first contact surface enabling the actuation lever to apply a substantially vertical operating force upon the pump device when rotated, thereby dispensing the liquid product. In a preferred embodiment the liquid is dispensed as an atomized spray.

19 Claims, 6 Drawing Sheets

U.S. PATENT DOCUMENTS 3,967,763 7/1976 Focht .
4,029,261 6/1977 Olegnowicz .
4,061,247 12/1977 Meshberg .
4,061,250 12/1977 Tada .
4,065,038 12/1977 Magers et al. .
4,077,548 3/1978 Beard .
4,082,223 4/1978 Nozawa .
4,089,442 5/1978 Hafele et al. .
4,090,644 5/1978 Fegley .
4,120,430 10/1978 French ..... 222/321.8 X
4,124,148 11/1978 Vieler et al. .
4,132,359 1/1979 Nozawa .
4,138,039 2/1979 Micallef .
4,157,774 6/1979 Micallef .
4,174,056 11/1979 Loeffler .
4,185,776 1/1980 Nozawa .
4,186,855 2/1980 Edman et al. .
4,188,412 2/1980 Sejpal .
4,198,756 4/1980 Dragan .
4,215,804 8/1980 Giuffredi .
4,248,360 2/1981 Crump .
4,249,681 2/1981 French .
4,252,507 2/1981 Knickerbocker .
4,264,037 4/1981 Nozawa .
4,264,038 4/1981 Nozawa .
4,271,990 6/1981 Kutik et al. .
4,276,992 7/1981 Susich .
4,277,001 7/1981 Nozawa .
4,278,187 7/1981 Luedtke ..... 222/321.8 X
4,345,718 8/1982 Horvath .
4,361,255 11/1982 Saito et al. .
4,369,900 1/1983 Saito et al. .
4,401,240 8/1983 Brack .
4,402,432 9/1983 Corsette .
4,434,915 3/1984 Kirk, Jr. .
4,434,917 3/1984 Saito et al. .
4,441,633 4/1984 Bennett .
4,452,379 6/1984 Bundschuh .
4,456,153 6/1984 Meshberg .
4,496,085 1/1985 Ford et al. .
4,503,997 3/1985 Corsette .
4,506,805 3/1985 Marcon .
4,511,069 4/1985 Kalat .
4,538,748 9/1985 Ford et al. .
4,558,821 12/1985 Tada et al. .
4,579,258 4/1986 Brown et al. .
4,618,076 10/1986 Silvenis .
4,643,338 2/1987 Iizuka .
4,646,969 3/1987 Sorm et al. ..... 222/321.8 X
4,705,191 11/1987 Itzel et al. .
4,735,008 4/1988 Williams .
4,759,309 7/1988 Zediker .
4,773,571 9/1988 Hagan et al. .
4,775,079 10/1988 Grothoff .
4,790,095 12/1988 Campos .
4,801,049 1/1989 Thompson .
4,809,878 3/1989 Rainey .
4,821,928 4/1989 Su .
4,826,052 5/1989 Micallef .
4,896,799 1/1990 Giuffredi .
4,915,263 4/1990 Corba .
4,917,303 4/1990 Maas et al. .
4,923,094 5/1990 O'Neill .
4,925,066 5/1990 Rosenbaum .
4,929,410 5/1990 Meyer et al. .
4,930,670 6/1990 Kuo .
4,932,567 6/1990 Tanabe et al. .
4,938,392 7/1990 Su .
4,944,432 7/1990 Jouillat .
4,971,257 11/1990 Birge .
4,993,214 2/1991 Corba ..... 222/321.8 X
5,016,780 5/1991 Moretti .
5,018,647 5/1991 Abplanalf .
5,025,956 6/1991 Linsenbigler .
5,037,007 8/1991 Deussen .
5,064,102 11/1991 Montaner .
5,083,683 1/1992 Knickerbocker .
5,100,027 3/1992 Gueret .
5,152,436 10/1992 Maas et al. .
5,154,328 10/1992 Gueret .
5,156,285 10/1992 Zogg et al. .
5,160,071 11/1992 Wright .
5,163,588 11/1992 Cater .
5,172,836 12/1992 Warner .
5,207,359 5/1993 Steijns .
5,219,098 6/1993 Tada .
5,222,632 6/1993 Tada .
5,224,614 7/1993 Bono et al. .
5,234,135 8/1993 LaFosse et al. .
5,242,090 9/1993 Reyss .
5,248,068 9/1993 Goergen et al. .
5,249,713 10/1993 Reich et al. .
5,263,616 11/1993 Abplanalp .
5,277,340 1/1994 Van Brocklin .
5,358,149 10/1994 O'Neill .
5,358,179 10/1994 Lund et al. .
5,388,766 2/1995 Buisson .
5,392,950 2/1995 Foss et al. .
5,406,731 4/1995 Stevens .
5,431,313 7/1995 Renault .
5,503,284 4/1996 Li .
5,547,091 8/1996 Neveras et al. .
5,551,607 9/1996 DeJonge, Sr. et al. .
5,558,257 9/1996 Braun .
5,573,143 11/1996 Deardurff et al. .
5,588,560 12/1996 Benedict et al. .
5,597,095 1/1997 Ferrara, Jr. .

BLOW MOLDED CONTAINER HAVING PIVOTAL CONNECTOR FOR AN ACTUATION LEVER

FIELD OF THE INVENTION

The present invention relates to molded packages for dispensing liquid products; and more particularly, to packages that include blow molded containers and actuation levers for actuating manually operated pumps in order to dispense liquid products.

BACKGROUND OF THE INVENTION

Many types of manually-actuated, reciprocating, vertically disposed plunger, pump devices have been utilized to dispense liquids in an atomized spray. However, when attempting to atomize a relatively viscous liquid using such a pump device, a large amount of downward force must be applied by the consumer in order to actuate the pump device. Additionally, if the pump device is a precompression style pump, it will require an even greater force to initiate a dispensing cycle. This increased force to dispense makes such pump devices very difficult for many consumers to operate. In order to resolve this problem, several packages have been introduced with a variety of actuation aids, attachments, and mechanical leverage mechanisms. These mechanisms typically operate as force multipliers providing additional leverage and assisting the user in increasing the amount of force applied onto the spray head of the pump device. Such force multipliers can make the pump device easier to operate.

Other pump devices have trigger-sprayer type mechanisms that act as force multipliers. Trigger-sprayer type pump devices provide a package that is easier to actuate and control during use since a more natural squeezing motion of the hand is utilized. However, most of these trigger-sprayer type mechanisms are attached to the container in a static manner. For example, some trigger-sprayers can be threaded onto the neck finish of a blow molded bottle, affixed to the bottle cap or closure, or even statically snapped into place around the neck finish or shoulder of the bottle. Still other liquid dispensing mechanisms utilize various complex components or parts in order to form or assist in positioning an actuation lever. These mechanisms tend to create numerous other problematic concerns, such as, increased costs during manufacture, complex operations during assembly, confusion during use and other consumer noticeable difficulties. Thus, it is one of the objects of this invention to provide a package having a force multiplying feature for use with a pump device that is simple in design, inexpensive, and easy to manufacture. Still another object of this invention is to provide a package having an actuation lever distinctly different from traditional trigger-sprayer type packages.

A further concern for consumer products dispensed from containers using manually actuated pump devices having mechanical actuation levers is that some of these packages are very difficult for household consumers to operate with one hand. Many of such packages are relatively bulky, hard to grip, or have actuation levers that extend an uncomfortable distance away from the container. Thus, another object of this invention is to provide a dispensing package that is comfortable for a wide range of people to operate with one hand. These and other objectives will be better understood with reference to the following disclosure.

SUMMARY OF THE INVENTION

In one aspect of this invention, a package is provided for dispensing a liquid product having a hollow container body that includes an aperture. The container body also includes a closed bottom end and a pivotal connection. A pump device is attached to the aperture of the container body and the pump device has a first contact surface located on a portion thereof. An actuation lever is pivotally connected to the container body at the pivotal connection in order to allow arcuate movement of the actuation lever. Preferably the actuator lever is constructed as a single unitary piece. The actuation lever includes a second contact surface which cooperates with the first contact surface enabling the actuation lever to apply an operating force upon the pump device during arcuate movement in order to dispense the liquid product from the container body through the pump device.

In another embodiment of this invention, a package is provided for dispensing a liquid product in an atomized spray. The package has a one-piece, integral, blow molded container body that includes a neck finish having an aperture therein. The container body also includes an integral pivotal connection. A pump device including a spray nozzle and a closure is provided. The closure being engaged with the neck finish such that the pump device is attached in fluid communication to the container body through the aperture in the neck finish. The pump device also includes a first contact surface located on an upper portion of the pump device. A unitarily formed actuation lever is pivotally connected to the container body at the pivotal connection. The pivotal connection allows arcuate movement of the actuation lever relative to the container body. The actuation lever has a second contact surface which cooperates with the first contact surface during arcuate movement in order to apply a substantially vertical downward operating force upon the pump device when the actuation lever is actuated. The liquid product is thereby dispensed from the package and through the spray nozzle in an atomized spray.

BRIEF DESCRIPTION OF THE DRAWINGS

While the specification concludes with claims which particularly point out and distinctly claim the invention, it is believed that the present invention will be better understood from the following detailed description taken in conjunction with the appended claims and the accompanying drawings, in which like reference numerals identify identical elements and wherein:

DETAILED DESCRIPTION OF THE INVENTION

Figure 1:
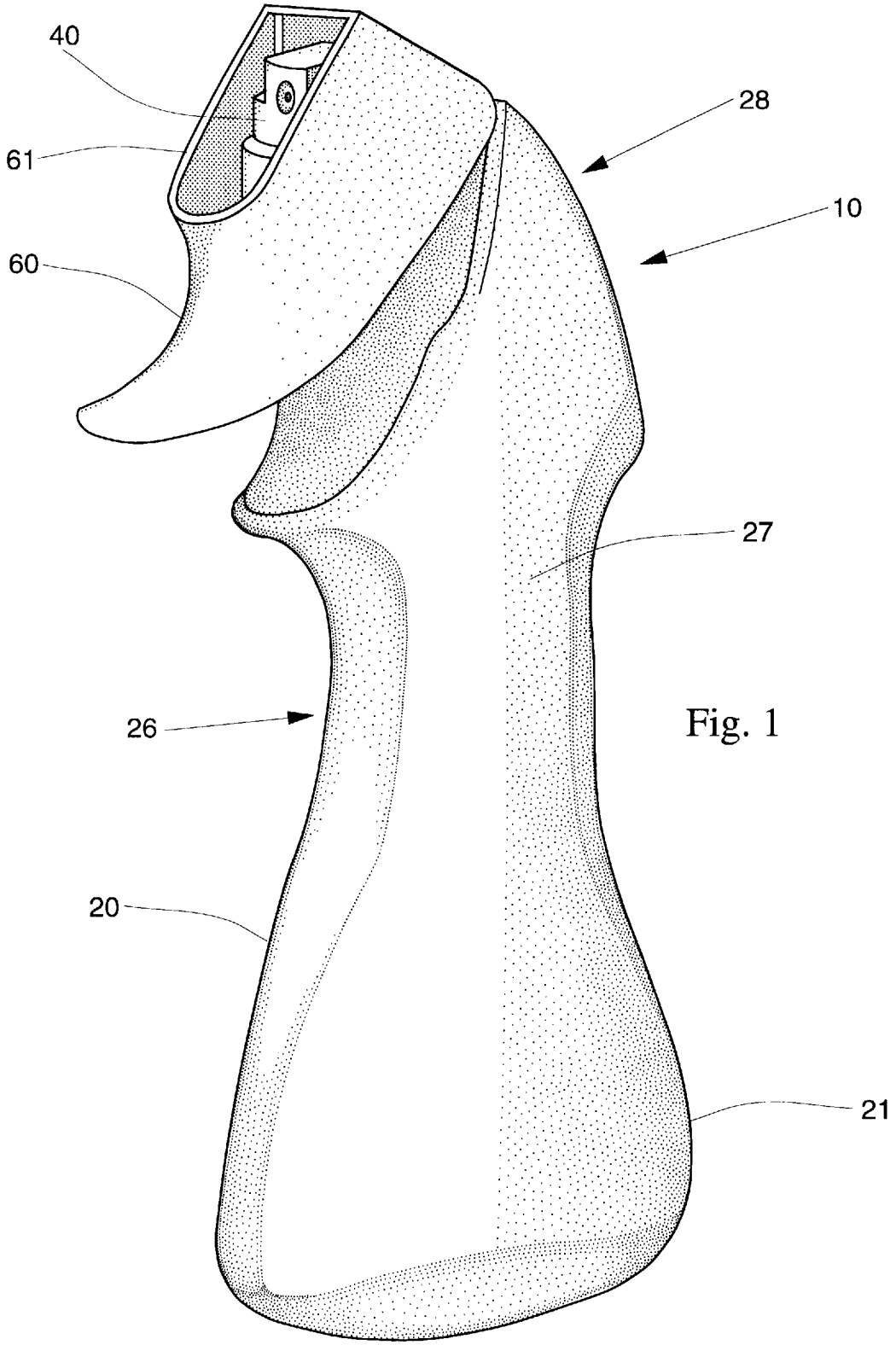
FIG. 1 is a perspective view of a preferred embodiment of the package of the present invention.

In a particularly preferred embodiment seen in FIG. 1, the present invention provides a package for dispensing a liquid product, indicated generally as 10. Package 10 includes a container body 20 and actuation lever 60. Actuation lever 60 has an outlet 61 therethrough and is pivotally connected to container body 20. Container body 20 of the present invention is preferably a one-piece integral bottle that is configured to contain a liquid product. As used herein, the term "integral" is defined as molded, or otherwise formed, as a single unitary part.

Container body 20 further includes a middle portion 26 connecting upper portion 28 and closed bottom end 21. Upper portion 28, bottom end 21, and middle portion 26 collectively define a hollow interior of container body 20 which contains the liquid product. Middle portion 26 of container body 20 includes a substantially rigid grip area 27 that is located between upper portion 28 and closed bottom end 21. Furthermore, bottom end 21 of container body 20 is preferably substantially rigid so as to give stability to container body 20 and allow container body 20 to stand in an upright position when not in use, as seen in FIG. 1.

Substantially rigid indicates that while the grip area 27 and bottom end 21 are flexible, a user can easily grasp grip area 27 of container body 20 and actuate pump device 40 without causing any appreciable deformation or distortion of grip area 27 or bottom end 21. Grip area 27 is preferably configured to conform to a wide variety of human hand sizes.

Figure 2:
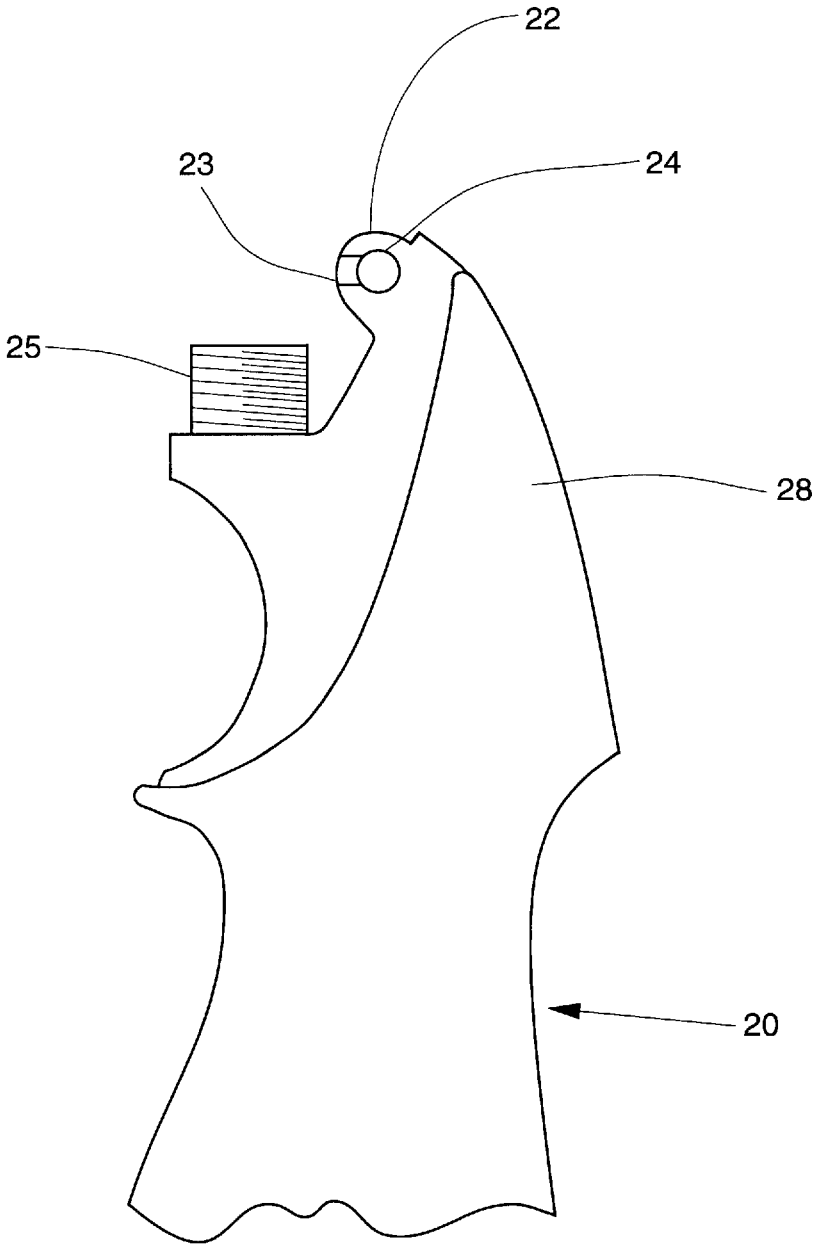
FIG. 2 is a partial side plan view of a preferred embodiment of the container body of the present invention.

As seen in FIG. 2, upper portion 28 of container body 20 includes neck finish 25. Neck finish 25 has an aperture therethrough and the hollow interior of container body 20 can be accessed through the aperture. One unique feature of container body 20 is pivotal connection 24 which is included in upper portion 28. Pivotal connection 24 can be integrally formed with container body 20 and preferably pivotal connection is integrally blow molded with container body 20. One advantage of integrally forming pivotal connection 24 with container body 20 is that a significant cost savings can be achieved. Preferably pivotal connection 24 is located above the aperture in neck finish 25 on an integral extension 22 extending upward from upper portion 28 of container body 20. An engagement slot 23 that cooperates with pivotal connection 24 can be provided on integral extension 22.

Container body 20 is preferably blow molded from a plastic material and can be a blow molded bottle of varying shape or size for containing a liquid. Container body 20, of the present invention, is preferably constructed by an extrusion blow molding method using a plastic material such as, polypropylene, polyvinyl chloride. Polyethylene is a preferred plastic material for making container body 20 and more preferably HDPE.

Other methods, such as stretch blow molding or injection molding, can also be used in the manufacture of container body 20 of the present invention. Such alternative methods of manufacture can result in wall thickness distributions across container body 20 that are slightly different than those produced by extrusion blow molding. For example, the wall thickness of container body 20 can be uniform or irregular.

A preferred method of blow molding a thermoplastic container body 20 having neck finish 25 and upper portion 28 with integral extension 22 and pivotal connection 24 is by use of the following method. Initially forming a hollow parison of thermoplastic material having an open end corresponding to neck finish 25. The parison is then preblown. The parison is placed within a mold cavity which has a body forming portion, a neck forming portion, an upper forming portion, and an extension-forming portion. The extension-forming portion is located in the upper forming portion adjacent to and above the neck-forming portion. The extension-forming portion of the mold cavity includes a recess forming portion which comprises trunnion shaped protrusions. The open end of the parison is placed within the neck-forming portion of the mold cavity. The next step is inserting a mandrel or blow pin into the parison. The mandrel includes a blowing mechanism connected to a pressure source having an air pressure of about 60 psi or greater. Pressure is then introduced through the blowing mechanism of the mandrel into the interior of the parison. The parison is expanded against the inner surfaces of body forming portion, upper forming portion, and extension forming portion including recess forming portion. Thus, container body 20 including upper portion 28 having integral extension 22 and pivotal connection 24 is integrally formed. Container body 20 can then be removed from the mold cavity and the mandrel withdrawn from neck finish 25 of container body 20.

The dimensional characteristics and thickness of the parison can vary according to several variables, including for example, the particular thermoplastic material selected, as well as, the size, shape, and desired wall thicknesses of container body 20. Extruding type blow molding machines can also generate particular predetermined profiles or thicknesses of the parison in order to ensure a substantially uniform wall thickness in the resulting container body 20. Such machines can also repetitively provide a parison thickness profile that ensures sufficient thermoplastic material in upper portion 28 to form integral extension 22 and pivotal connection 24 of container body 20.

Figure 3:
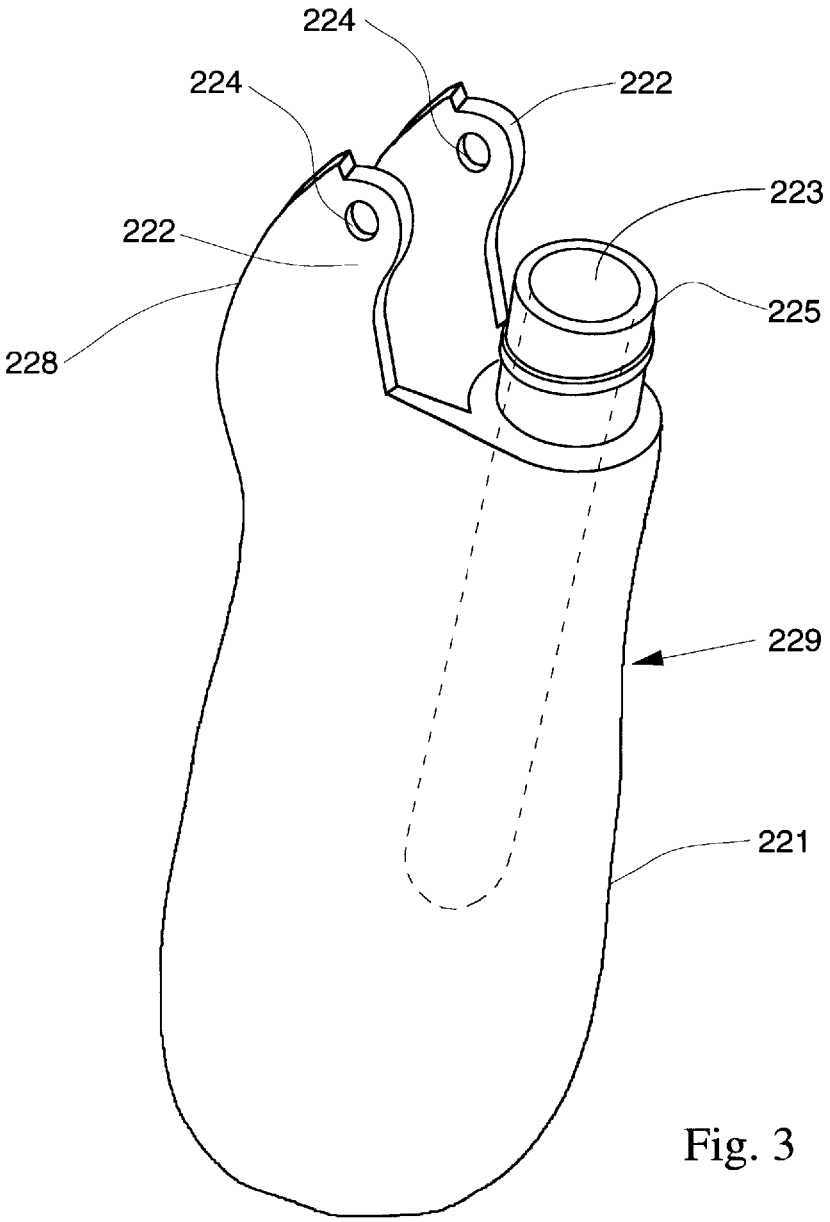
FIG. 3 is a perspective view of an alternative embodiment of the preform of the present invention.

Alternatively, as seen in FIG. 3, pivotal connection 224 can be formed using various other methods. FIG. 3 depicts an injection molded preform 229 that can be used for making an alternative embodiment of container body 20. For example, integral extension 222 can be injection molded including pivotal connection 224 or, the entire upper portion 228 can be injection molded as part of preform 229 with pivotal connection 224 located above or adjacent to neck finish 225. In this alternative embodiment, two upper portions 228 each include pivotal connection 224 located on integral extension 222. Pivotal connection 224 can be in the form of a recess in integral extension 222 or, more preferably, can be a hole that extends through integral extension 222. Preform 229 consists of tube portion 221 integral with upper portion 228. Tube portion 221 also includes neck finish 225 having an aperture 223 therethrough. If desired, tube portion 221 can be used as is or completed by blow molding in order to form middle portion 26 and closed bottom end 21 of container body 20 similar to that depicted in FIG. 1.

Figure 4:
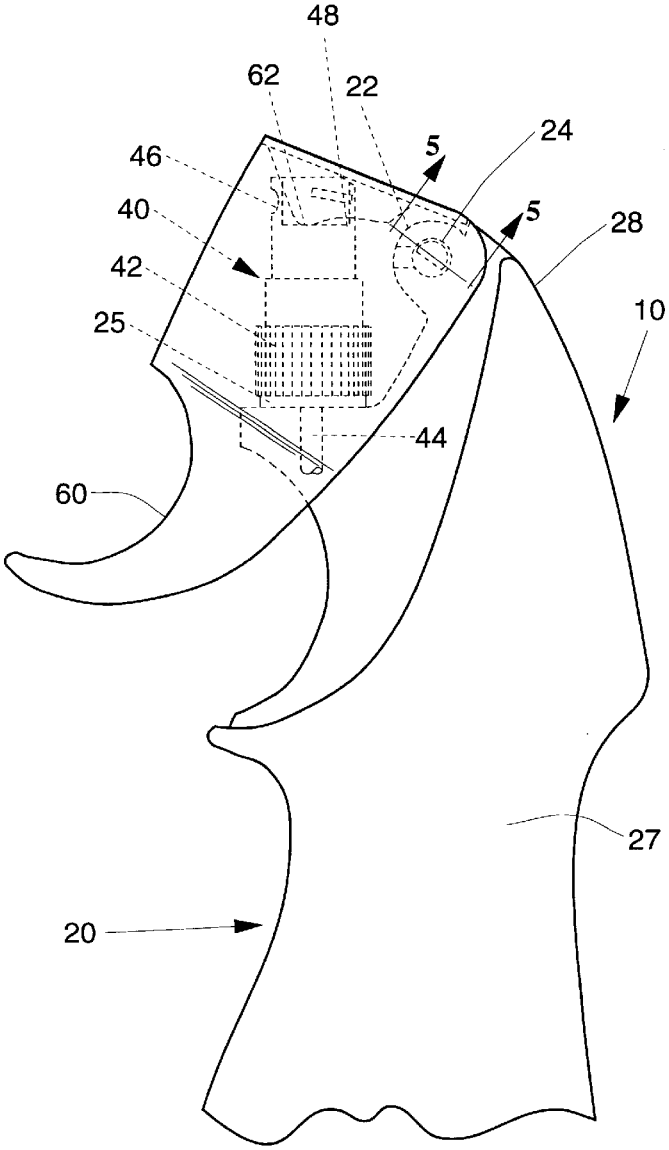
FIG. 4 is a partial side plan view of a preferred embodiment of the package of the present invention.

Referring now to FIG. 4, neck finish 25 is adapted to engage with closure 42 of pump device 40. Preferably, neck finish 25 includes external threads for engagement with internal threads on closure 42. Alternatively, neck finish 25 and closure 42 can be engaged using a bayonet style connection or the like. Preferably neck finish 25 and closure 42 engage in a leak-tight manner when pump device 40 is attached to container body 20.

Preferably, pivotal connection 24 enables actuation lever 60 to be pivotally connected directly to container body 20 and provides a pivot point about which actuation lever 60 rotates. Thus, pivotal connection 24 allows actuation lever 60 to move in an arcuate manner relative to container body 20. Since in a preferred embodiment, pivotal connection 24 is blow molded integral with container body 20, a distinct benefit is that no separately molded or independently fabricated support structure is needed in order to connect actuation lever 60 to container body 20 and thus, a simple and easy to assemble package 10 is produced.

Figure 5:
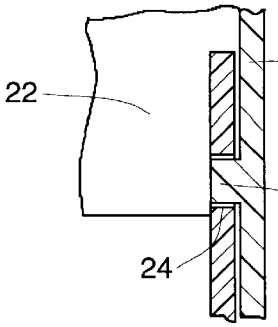
FIG. 5 is a partial cross-sectional view of a preferred embodiment taken along line 5—5 of the package as shown in FIG. 4.

While the preferred pivotal connection 24 comprises a recess integrally blow molded with container body 20, other alternative embodiments of pivotal connection 24 can be utilized. For example, separately fabricated or independently molded components such as bushings, spindles, bearings, or the like can be affixed, glued, attached or bonded onto upper portion 28 in order to form pivotal connection 24. Preferably as seen in FIG. 5, a trunnion 63 is provided on actuation lever 60. Pivotal connection 24 and trunnion 63 cooperate, preferably in a snap fit manner, in order to pivotally attach actuation lever 60 onto container body 20. More preferably, during installation of actuation lever 60, trunnion 63 aligns with engagement slot 23 in order to allow ease of engagement with pivotal connection 24. Trunnion 63 or pivotal connection 24 must to be able to move relative to its cooperating member in order to allow arcuate movement of actuation lever 60 relative to container body 20. Additionally, multiple pivotal connections 24, multiple integral extensions 22, multiple upper portions 28, as well as multiple trunnions 63 can be utilized in package 10 of the present invention.

Figure 6:
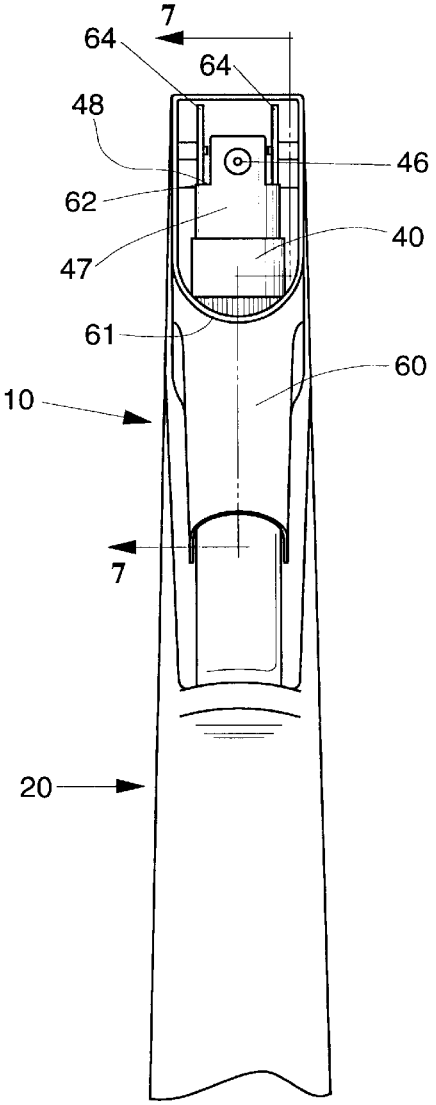
FIG. 6 is a partial front plan view of a preferred embodiment of the package of the present invention.

As seen in FIGS. 4 & 6, pump device 40 can be attached to container body 20 by engaging neck finish 25. Pump device 40 is preferably a vertically disposed plunger type pump on which a substantially vertical actuation force is applied in order to initiate a dispensing cycle. Vertically disposed plunger type pumps have long been used to dispense liquid products from bottles, jars and the like. Such a pump device 40 includes dip tube 44 which extends downward through the aperture in neck finish 25 and into the hollow interior of container body 20 placing pump device 40 in fluid communication with the liquid product contained within container body 20. Pump device 40 has a discharge orifice 46 through which the liquid product is dispensed. Discharge orifice 46 can be in the form of a spray nozzle or can be an opening which dispenses the liquid product in a variety of forms, including for example, foams, dispersed sprays, streams, impinging streams, atomized sprays, and the like. Typically such pump devices 40 are manually actuated by the user when the user grasps the package 10 with one hand at grip area 27 and applies a substantially downward force on the spray head of the vertically disposed plunger type pump device 40. Preferably, pump device 40 preferably dispenses a predetermined quantity of liquid product from container body 20 during each dispensing cycle.

While a wide variety of pump devices 40 can be used in the present invention, the particular version depicted in FIG. 6 is illustrative of the operating features typical of such pump devices 40. A more detailed description of the features and components of this particularly preferred pump device 40 can be found in U.S. Pat. No. 4,941,595 issued Jul. 17, 1990 to Montaner et al.; U.S. Pat. No. 5,025,958 issued Jun. 25, 1991 to Montaner et al.; and U.S. Pat. No. 5,064,105 issued Nov. 12, 1991 to Montaner, all of which are hereby incorporated herein by reference. Pump devices 40 such as these are commercially available and are sold by Calmar Dispensing Systems, Inc. under the trade name CALMAR MARK IV™.

Pump device 40 includes spray head 47 having a first contact surface 48 which is located on a top portion of spray head 47. Actuation lever 60 includes alignment lug 64. Preferably actuation lever 60 includes at least two alignment lugs 64 that are incorporated into actuation lever 60 on opposite sides of spray head 47. Alignment lugs 64 are used to properly orient spray head 47 and discharge orifice 46 of pump device 40 with outlet 61 in actuation lever 60. Thus alignment lugs 64 provide improved directional control of the liquid product dispensed by assuring that discharge orifice 46 is properly oriented during use. Actuation lever 60 preferably comprises a trigger that is unitarily formed of a plastic material.

Figure 7:
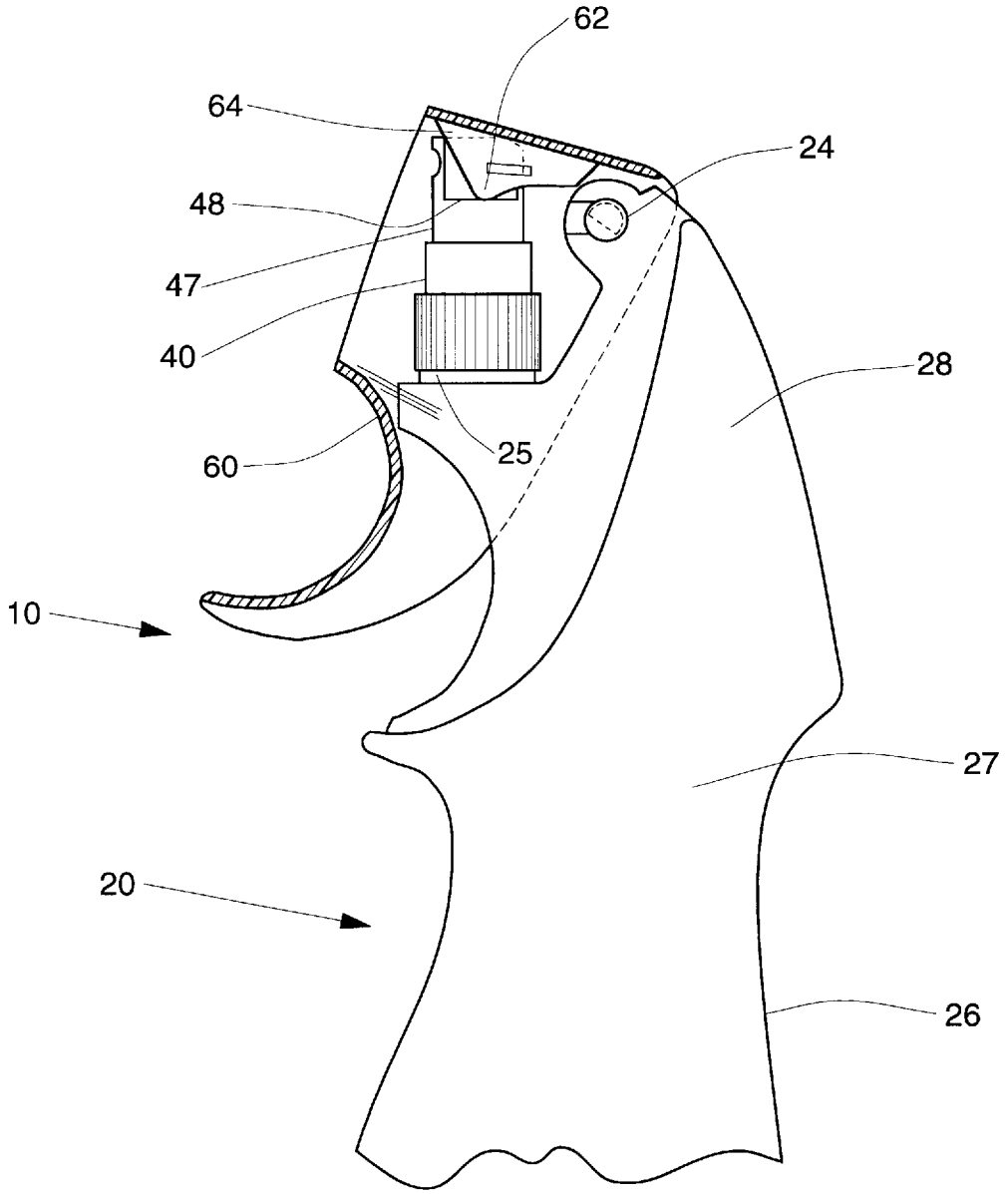
FIG. 7 is a partial cross-sectional view of a preferred embodiment taken along line 7—7 of the package as shown in FIG. 6 with the actuation lever in the up position; and, FIG. 8 is a view of the package shown in FIG. 7 with the actuation lever in the down position.
Figure 8:
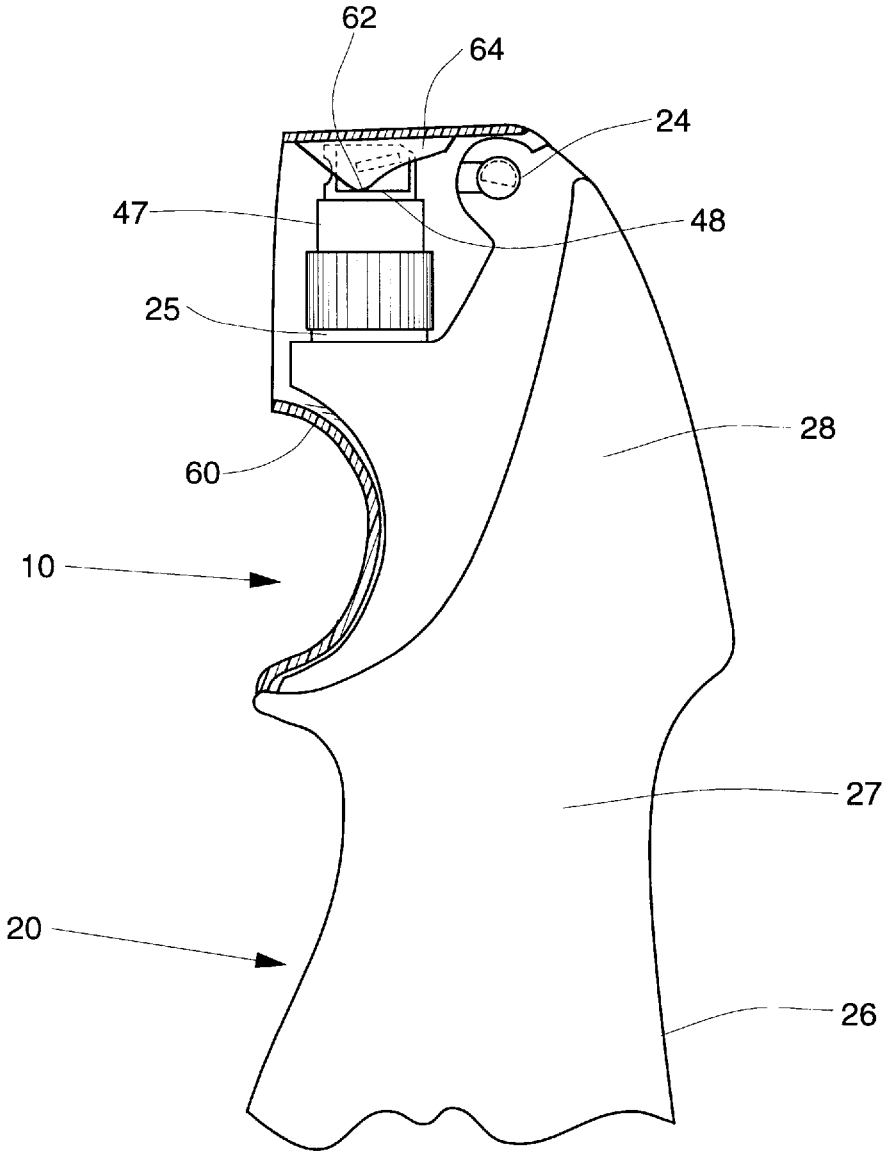

Referring now to FIGS. 7 & 8, alignment lug 64 includes second contact surface 62 which cooperates with first contact surface 48 enabling actuation lever 60 to apply a substantially vertical operating force upon pump device 40 when actuation lever 60 is moved in an arcuate manner. Actuation lever 60 rotates or moves in an arcuate manner in response to the application of a substantially horizontal force applied by the index finger of the user. Alignment lug 64 and spray head 47 are arranged to minimize the distance between pivotal connection 24 and the vertical axis of pump device 40 in order to minimize movement and friction between first contact surface 48 and second contact surface 62 during use. Preferably pivotal connection 24 is located adjacent to pump device 40 and above neck finish 25. Thus, actuation lever 60 moves in a manner that causes second contact surface 62 to apply a substantially vertical operating force upon first contact surface 48. Since actuation lever 60 acts as a force multiplier, preferably, the substantially vertical operating force is about 4 times greater than the substantially horizontal force applied to actuation lever 60.

During use, the user typically grabs container body 20 at middle portion 26 about grip area 27 with one hand. Grip area 27 is configured to provide secure one-handed grasping and actuation of pump device 40 while at the same time maintaining the desired placement of the index finger around actuation lever 60. Middle portion 26 is sized to accommodate a wide variety of human hand sizes. In this particular configuration, the user's hand naturally wraps around middle portion 26 with the index finger naturally wrapping around actuation lever 60 while upper portion 28 of container body 20 rests comfortably upon the web of the hand between the index finger and the thumb. This arrangement helps to assure that package 10 does not slip out of the users hand during use even when the outer surface of container body 20 becomes wet, oily, or slick. Thus, grip area 27 of middle portion 26 comfortably, effectively, and naturally accommodates various sizes of human hands. These and other ergonomic features have been incorporated into package 10 in order to maximize positive functional interfaces between package 10 and the human user.

For example, while actuation lever 60 moves in an arcuate manner applying a substantially vertical operating force onto pump device 40, the user simply applies a substantially horizontal actuation force onto actuation lever 60. This substantially horizontal actuation force conforms to the natural movement of the index finger of the user. Also, the lower end of actuation lever 60 preferably has a contour that conforms to and wraps closely around container body 20. This wrap around configuration of actuation lever 60 provides structural integrity while enabling maximum arcuate travel of actuation lever 60 relative to container body 20. This wrap around configuration also provides a shorter reach to actuation lever 60 and thereby avoids any over extension of the user's index finger.

Additionally, the wrist and the two bones of the lower arm form a stiff and relatively inflexible bridge in the plane of the palm of the hand when package 10 is grasped at grip area 27. This also forms a loose hinge between the wrist and the hand in a plane perpendicular to the palm of the hand. The weight of package 10 is therefore directly supported by the relatively inflexible bridge while the dispensed liquid is aimed and directed by the loose hinge arrangement. This provides for an ergonomically appropriate use of the natural structures of the hand and arm. Such a natural positioning of the hand is not only more comfortable but also enables the user to apply a greater actuation force with the index finger upon actuation lever 60 since the wrist is unconstrained. A quicker actuation stroke is also achievable along with a firmer grip of container body 20 at grip area 27 by the remaining fingers of the hand. Thus, package 10 of the present invention is ergonomically superior in that the natural mechanical structure of the human arm and hand are more effectively utilized.

Different sized packages 10, allowing for various liquid product volumes, can be made by enlarging container body 20. The distance from upper portion 28 to bottom end 21 can be increased without compromising the user's ability to grasp and operate package 10. For example, grip portion 27 can be maintained constant while middle portion 26 is enlarged or bottom end 21 extended.

Many liquid products can be dispensed from this package 10 including, for example, hair spray, cleaning solutions, hard surface cleaners, pretreaters, soaps, liquid detergents, lotions, cosmetic products, perfumes, mousses, edible oils, flavor enhancers, cooking sprays, fruit and vegetable rinse, paints, polishes, window cleaners, lubricating oils, adhesives, and the like. One liquid product of particular interest is cooking oil. Preferably the cooking oil comprises a vegetable oil based cooking spray having a viscosity greater than 60 cps. Such cooking oil can be, for example, a vegetable oil-based liquid used in food preparation, pan coatings or flavor enhancement.

Preferably such liquid products are dispensed in an atomized spray. When attempting to dispense a liquid product having a viscosity greater than about 60 cps., in an atomized spray, typically a greater amount of downward operating force must be applied to spray head 47 of pump device 40. Often this makes initiation of a dispensing cycle difficult for some typical household consumers. Thus, a distinct benefit of package 10 is that actuation lever 60 acts as a force multiplier which helps to increase the amount of downward operating force a user can apply to pump device 40 for a given amount of substantially horizontal actuation force applied onto actuation lever 60. As such, the use of package 10 can increase the effectiveness of many liquid products by making it easier for some typical household consumers to dispense these products.

While particular versions and embodiments of the present invention have been illustrated and described, various modifications will be apparent to those skilled in the art without departing from the teachings of the present invention. Accordingly, the scope of the present invention should be considered in terms of the following claims.

What is claimed is:

1. A package for dispensing a liquid product comprising:

(a) a hollow, one-piece integral container body including an upper portion and a closed bottom end, said upper portion including an integral extension and a neck finish, said integral extension extending upward from said upper portion, and said neck finish having an aperture therethrough; and (b) a pivotal connection on said integral extension, said pivotal connection located above said aperture of said neck finish; and (c) a pump device attached to said aperture, said pump device having a first contact surface; and (d) an actuation lever pivotally connected to said container body at said pivotal connection allowing arcuate movement of said actuation lever, said actuation lever having a second contact surface which cooperates with said first contact surface enabling said actuation lever to apply an operating force upon said pump device during said arcuate movement in order to dispense said liquid product.

2. The package for dispensing a liquid product according to claim 1, further comprising a middle portion of said container body located between said closed bottom end and said upper portion, said middle portion including a substantially rigid grip area.

3. The package for dispensing a liquid product according to claim 1, wherein said actuation lever comprises a trigger, unitarily formed of a plastic material.

4. The package for dispensing a liquid product according to claim 1, wherein said container body comprises an integrally molded bottle.

5. The package for dispensing a liquid product according to claim 4, wherein said bottle is blow molded.

6. The package for dispensing a liquid product according to claim 1, wherein said first contact surface further comprises a shoulder and said second contact surface further comprises an alignment lug, said alignment lug cooperating with said shoulder in order to orient said pump device.

7. The package for dispensing a liquid product according to claim 1, wherein said arcuate movement of said actuation lever is in response to the application of a substantially horizontal force upon said actuation lever such that said actuation lever rotates causing said second contact surface to apply a substantially vertical operating force upon said first contact surface, said operating force being about 4 times greater than said substantially horizontal force.

8. The package for dispensing a liquid product according to claim 1, wherein said actuation lever includes a lower end, said lower end of said actuation lever having a contour that conforms to said container body.

9. The package for dispensing a liquid product according to claim 1, wherein said actuation lever includes a trunnion, said pivotal connection and said trunnion cooperating to form a snap fit that allows said trunnion to move relative to said pivotal connection.

10. The package for dispensing a liquid product according to claim 1, wherein said liquid product has a viscosity greater than about 60 cps.

11. The package for dispensing a liquid product according to claim 1, wherein said pump device includes a spray nozzle and said liquid product is dispensed in an atomized spray.

12. The package for dispensing a liquid product according to claim 1, wherein said pivotal connection comprises a separately fabricated component affixed to said integral extension of said upper portion.

13. A package for dispensing a liquid product in an atomized spray comprising:

(a) a one-piece integral blow molded container body that includes a neck furnish having an aperture therein, said container body also including a pivotal connection;

(b) a pump device including a spray nozzle and a closure, said closure engaging said neck finish such that said pump device is attached in fluid communication to said container body through said aperture in said neck finish, said pump device also including a first contact surface located on an upper portion thereof; and (c) a unitarily formed actuation lever pivotally connected to said container body at said pivotal connection, said pivotal connection allowing arcuate movement of said actuation lever, said actuation lever having a second contact surface which cooperates with said first contact surface during said arcuate movement of said actuation lever in order to apply an operating force upon said pump device and thereby dispensing said liquid product through said spray nozzle in an atomized spray.

14. The package for dispensing a liquid product in an atomized spray according to claim 13, wherein said atomized spray comprises a vegetable oil based cooking spray.

15. The package for dispensing a liquid product in an atomized spray according to claim 13, wherein said actuation lever comprises a trigger unitarily formed of a plastic material that moves in an arcuate manner in response to the application of a substantially horizontal force such that said trigger causes said first contact surface of said pump device to move in a substantially downward direction.

16. The package for dispensing a liquid product in an atomized spray according to claim 15, wherein said operating force is about 4 times larger than said substantially horizontal force.

17. The package for dispensing a liquid product in an atomized spray according to claim 13, wherein said pump device comprises a vertically disposed plunger-type pump device.

18. The package for dispensing a liquid product in an atomized spray according to claim 13, wherein said pivotal connection is located above said neck finish.

19. The package for dispensing a liquid product in an atomized spray according to claim 13, wherein said second contact surface comprises an alignment lug for orienting said pump device.

* * * * *